US005090662A

United States Patent [19]

Koo

[11] Patent Number: 5,090,662

[45] Date of Patent: Feb. 25, 1992

[54] STAPLE REMOVER

[76] Inventor: Ja M. Koo, 87-6 Dae Jo dong, Eun Pyoung-Ku, Seoul, Rep. of Korea, 122-030

[21] Appl. No.: 629,624

[22] Filed: Dec. 18, 1990

[30] Foreign Application Priority Data

Dec. 18, 1989 [KR] Rep. of Korea ..... 89-19166[U]

[51] Int. Cl.[5] ..... B25C 11/00

[52] U.S. Cl. ..... 254/28

[58] Field of Search ..... 254/28, 18; 7/125, 165, 7/166

[56] References Cited

U.S. PATENT DOCUMENTS

| | | | |
|---|---|---|---|
| 2,033,050 | 3/1936 | Pankonin . | |
| 3,143,800 | 8/1964 | Vizzi | 254/28 |
| 3,311,346 | 3/1967 | Almond | 254/28 |
| 4,784,370 | 11/1988 | Strickland | 254/28 |

FOREIGN PATENT DOCUMENTS

| | | |
|---|---|---|
| 29-13218 | 10/1954 | Japan . |
| 29-14207 | 11/1954 | Japan . |
| 37-16703 | 7/1962 | Japan . |
| 45-12070 | 5/1970 | Japan . |
| 47-9746 | 4/1972 | Japan . |
| 60-39476 | 3/1985 | Japan . |
| 87177 | 2/1987 | Rep. of Korea . |

*Primary Examiner*—Robert C. Watson

*Attorney, Agent, or Firm*—Fleit, Jacobson, Cohn, Price, Holman & Stern

[57] ABSTRACT

A staple remover has nippers formed on a side of its pivot opposite the staple removing jaws for gripping a staple bar. The nippers are formed by cross-bars connecting opposite flanges of the body members which form the staple remover.

1 Claim, 4 Drawing Sheets

STAPLE REMOVER

BACKGROUND OF THE INVENTION

The present invention relates to a staple remover for pulling and removing out a staple which is binding in a state of binding a number of piled papers by a stapler from said papers.

Generally, in case when a number of papers are desired to file and bind, staples formed with U-shape and arranged in plenty by joining aside are contained within a stapler, and papers are filed and bound by said stapler by utilizing said staple.

However, in case when it is required to release the bound state at a state that the papers are bound as above description, said staple of bound state should be pulled and removed out from the papers, and various means for this have been provided.

A staple remover which is a typical conventional means for removing such staple is shown in FIG. 1.

That is, conventional staple remover is made of structure that inner body piece 1 is inserted into the interior of side plate 3*f* of outer body piece 3 and then connecting by hinge pin 2, and said inner and outer body pieces 1, 3 are structured with staple removing forks 1*d*, 3*d*, and side plates 1*f*, 3*f*.

Said inner and outer body pieces 1, 3 have respectively staple removing forks 1*a*, 3*a* which have sharp and acute angle so as to be able to penetrate into staple binding the papers and being formed to face one another so as to be made a couple at its front end portion, and they have respectively curved portions 1*g*, 3*g* which are started from said staple removing forks 1*a*, 3*a* and being formed in arcuate shape so that pulling out continuously the staple pulled out from the papers by said staple removing forks 1*a*, 3*a*.

And, side plates 1*f*, 3*f* projected by predetermined magnitude from respective linear portions 1*d*, 3*d* starting from said curved portion 1*g*, 3*g* are formed at rear end portions of said inner and outer body pieces 1, 3 respectively, wherein inner and outer body pieces 1, 3 are connected by hinge pin 2 at a state that both side plates 1*f* of the inner body piece 1 are inserted between both side plates 3*f* of the outer body piece 3, and compression spring (not shown) for providing elasticity is mounted between the inner and outer body pieces 1, 3 and then the staple removing fork 1*a* of the inner body piece 1 moves within the interior of the staple removing fork 3*a* of the outer body piece 3*a*.

Accordingly, the both staple removing forks 1*a* of the inner body piece 1 had been moved within the interior of the both staple removing forks 3*a* of the outer body piece 3.

Therefore, in case when it is required to pull and remove out the staple of a state which is binding a number of papers from said papers, when an user applies a force to grippers 1*b*, 3*b* in a state that the staple removing forks 1*a*, 3*a* are approached to the staple, the staple removing forks 3*a* of the outer body piece 3 and the staple removing forks 1*a* of the inner body piece 1 are rotated in arcuate around the hinge pin 2 whereby simultaneously approaching from the both side of the staple in the direction confronting one another, according to this, each staple removing forks 1*a*, 3*a* move continuously in the direction confronting one another and thereby penetrating between the paper and bottom surface of the staple, and successively in response to the continuous moving of the staple removing forks 1*a*, 3*a*, the staple is lifted up along the curved portions 1*g*, 3*g* whereby being pulled and removed out of the papers.

However, according to the above-described conventional staple remover, sometimes a state has been occurred that only one side of the staple was pulled out instead the both ends stuck into the papers are simultaneously and completely pulled and removed out therefrom, in this case, there has been inconvenience that an user had to grip again the staple by finger and pull out it, therefore it has not been so useful.

OBJECT AND SUMMARY OF THE INVENTION

Therefore, it is an object of the present invention to provide a staple remover which includes a grasping means capable of completely pulling out a staple by primary action for pulling out the staple and simultaneously having nipper means capable of readily pulling it out without using finger of user.

For this purpose, the present invention is constructed in such a manner that projection for grasping the staple is formed at linear portion of any body piece of the inner and outer body pieces, and in the time of executing the action for removing the staple, it is made so as said projection and the linear portion of other side body piece corresponding to said projection press and grasp the staple in a state having a predetermined pressure so that the staple can be removed and at the same time, in case when one side of the stape is drawn out but other side is still stuck into the papers, in order to draw out this, nipper portion which is a separate nipper means for grasping the staple is formed at the rear end portion of the inner and outer body pieces respectively and thereby said nipper portion serves the nipper function around the hinge pin so that the staple can be readily pulled out.

The forgoing and other objects as well as advantages of the present invention will become clear by following description of the invention with reference to the accompanying drawings.

BRIEF DESCRIPTION OF THE DRAWINGS

For a better understanding of the invention, and to show how the same may be carried out into effect, reference will now be made, by way of example, with respect to the accompanying drawings, in which.

Throughout the drawings, like reference numerals and symbols are used for desingnating or equivalent parts or portions, for simplicity of illustration and explanation.

DETAILED DESCRIPTION OF THE INVENTION

Hereinafter, the present invention will be described in detail with reference to the accompanying drawings as followings.

Figure 1:
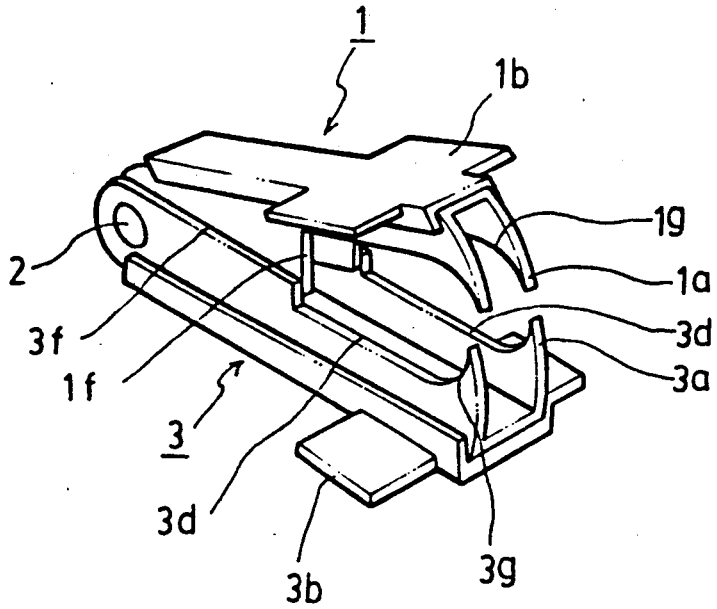
FIG. 1 PRIOR ART
FIG. 1 is a perspective view for showing a structure of conventional staple remover.
Figure 2:
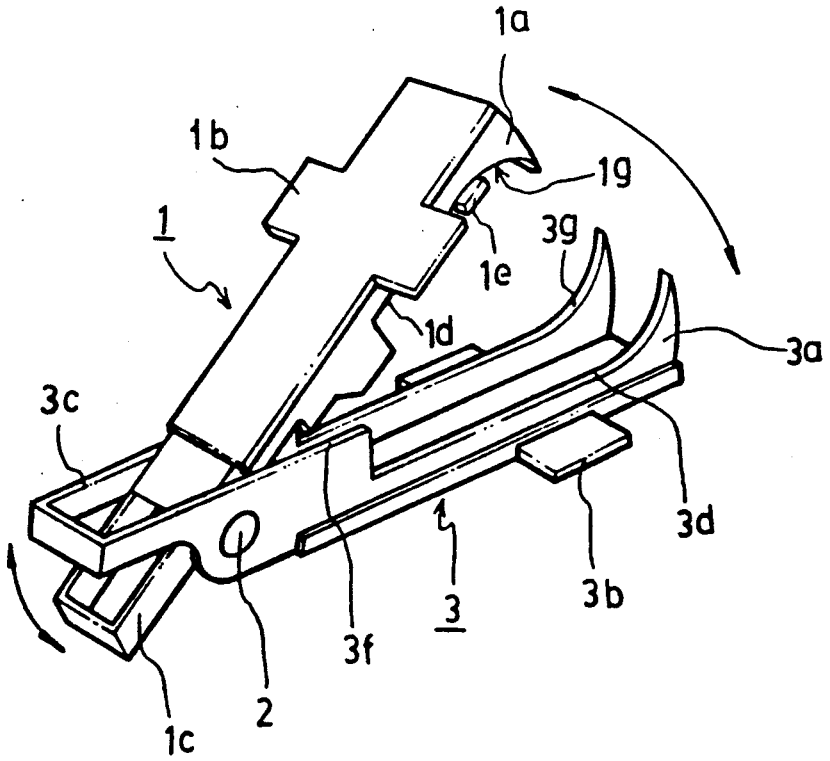
FIG. 2 is a perspective view for showing a structure in assembled state of the present invention.
Figure 3:
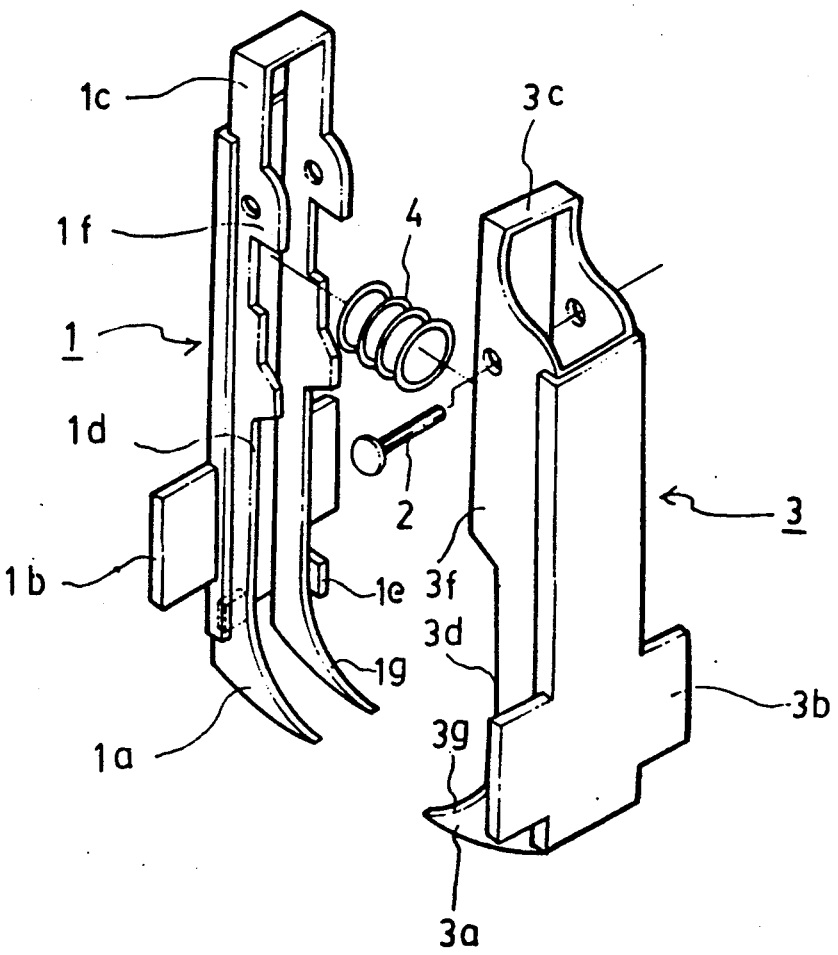
FIG. 3 is an exploded perspective view for showing a structure of the present invention.

FIG. 2 shows a state assembled for showing the structure according to a preferred embodiment of the present invention, and FIG. 3 shows a state disassembled this.

This staple remover according to the present invention is constructed in such a manner that outer body piece 3 and inner body piece 1 are provided, and said outer body piece 3 and the inner body piece 1 are connected by hinge pin 2, and elastic member 4 is provided between said both body pieces 1, 3.

And, staple removing fork 3*a* having sharp and acute angle so as to be able to penetrate the staple binding the papers as well as curved portion 3*g* having a predetermined curvature are formed at front end portion of said outer body piece 3, and nipper portion 3*c* which is formed in ⊓-shape and being nipper means for grasping the staple, is formed at rear end portion.

In said structure, the staple removing fork 3*a*, curved portion 3*g*, linear portion 3*d* starting from the ending portion of said curved portion 3*g*, side plate 3*f* formed so as to be protruded from the ending portion of said linear portion 3*d*, nipper portion 3*c* formed on the extended line of said side plate 3*f* are all integrally formed, and at the same time, each portions of similar formation are formed at oppositely confronting portions with predetermined distance so that symmetrical structure is formed.

Further, gripper for applying a force to outer body piece 3 upon removing the staple is fixed at one side surface of the outer body piece 3.

And, the inner body piece 1 is formed with respective portions such as, from the front end, the staple removing fork 1*a*, curved portion 1*g*, linear portion 1*d*, side plate 1*f*, and nipper portion 1*c* at the position confronting to said outer body piece 3 so as to have similar structure corresponding respectively with said outer body piece 3.

And, the side plates 1*f* of the inner body piece 1 is inserted between the both side plates 3*f* of the outer body piece 3, and said boty body pieces 1, 3 are connected by the hinge pin 2, so that the nipper portion 1*c* of the inner body piece 1 passes between the both nipper portions 3*c* of the outer body piece 3 so as to be projected to exterior.

Further, projected portion 1*e* for grasping by pressing the staple ascended along the curved portion 1*g* by a predetermined level upon executing the staple removing action is formed at the linear portion 1*d* starting from the ending portion of said curved portion 1*g* within the inner body piece 1, wherein this projected portion 1*e* is formed to be projected so as to abut to the linear portion 3*d* of the outer body piece 3 corresponding to the linear portion 1*d* of the inner body piece 1 formed with said projected portion 1*e*.

Said projected portion 1*e* may either be formed selectively to any one linear portion of the both linear portions 1*d* formed to two portions of the inner body piece 1, or may be formed to all of linear portions 1*a* of two portions as the projected portions 1*e*, 1*e'* shown in FIG. 3.

Furthermore, projected portion 3*e* may also be formed to the linear portion 3*d* of the outer body piece 3, which may either be formed selectively to any one linear portion of the linear portions 1*d*, 3*d* of the both body pieces 1, 3, or may be formed simultaneously to all linear portions 1*d*, 3*d*.

Figure 4A:
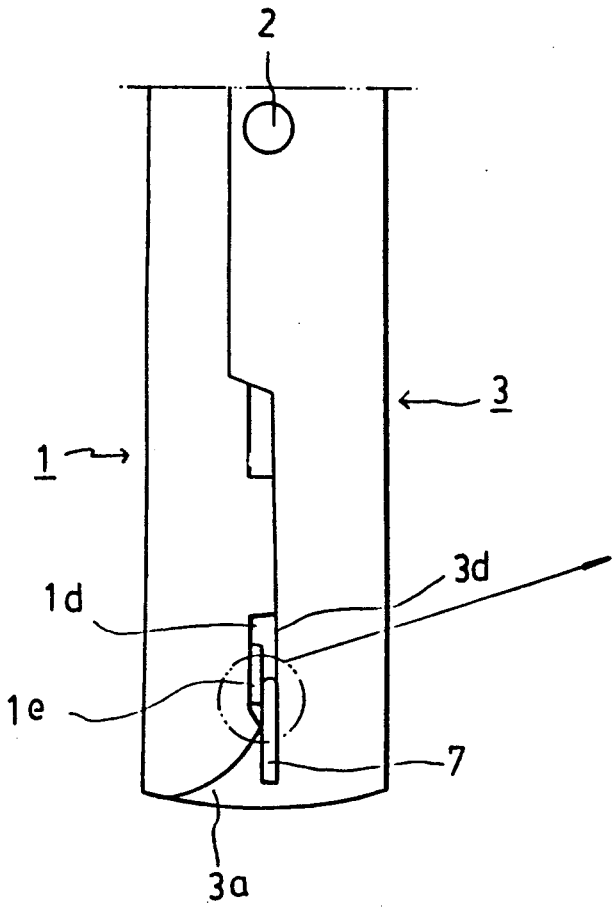
FIGS. 4A, 4B and 5 are front views for illustrating the operating state of the present invention.
Figure 4B:
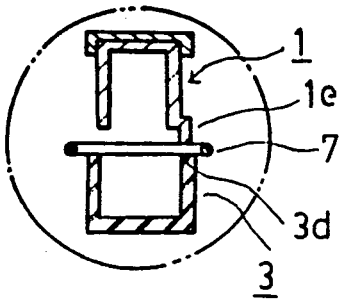

Therefore, in case of intending to pull out the staple in bound state, when a force is applied to the grippers 1*b*, 3*b* as shown in FIG. 4, the both staple removing forks 1*a*, 3*a* are rotated in arcuate as much as predetermined distance around the hinge pin 2, and at this moment, the both staple removing forks 1*a*, 3*a* proceed in the direction confronting one another whereby penetrating into the staple 7.

Successively, according to the continuous movement of the both staple removing forks 1*a*, 3*a*, the staple 7 is raised along the curved portions 1*g*, 3*g* whereby being pulled out.

At this moment, the staple 7 reached the projected portion 1*e* after passing the curved portions 1*g*, 3*g* is grasped with pressure by said projected portion 1*e* and the linear portion of other body piece confronting to said projected portion, and when the staple remover is pulled out in a state that the staple 7 is grasped, the staple is completely removed from the papers.

Figure 5:
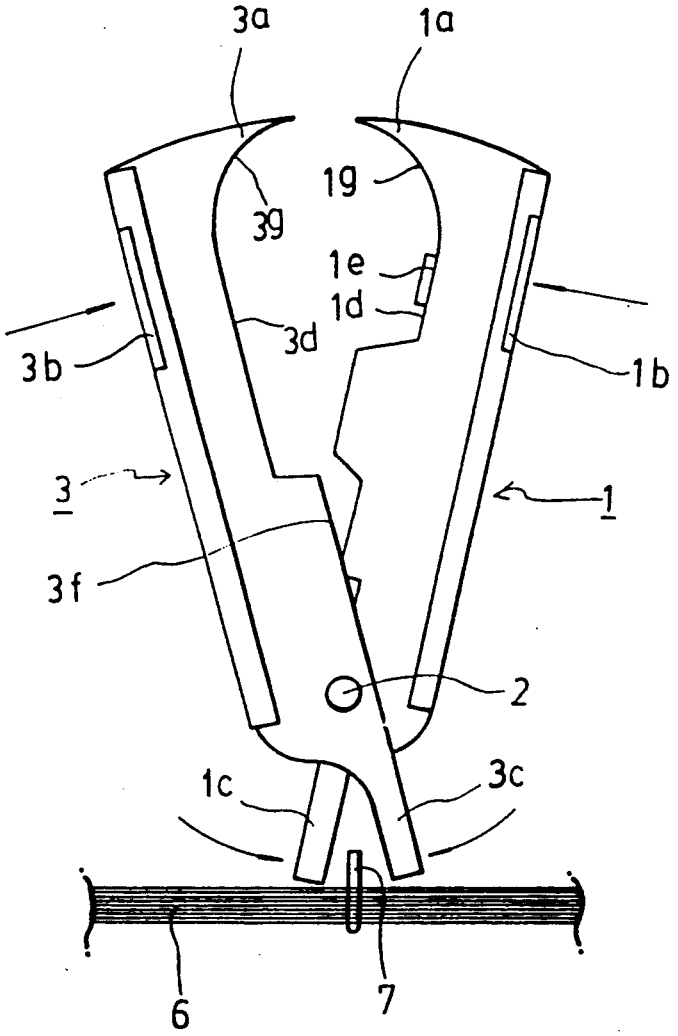

And, as above description, in the process for pulling out the staple by utilizing the staple removing forks, curved portions, and projected portions, in case when only one side of the staple is pulled out and other side is still stuck into the papers therefore this is desired to pull out, as shown in FIG. 5, when the nipper portions 1*c*, 3*c* formed to rear end portions of the both body pieces 1, 3 are made to direct to the staple and thereafter a force is applied to the grippers 1*b*, 3*b*, said both nipper portions 1*c*, 3*c* grasp with pressure the staple 7 as nipper, and when the staple remover is pulled out in this state, the staple is completely pulled out.

Thus, according to the present invention, the projected portion(s) 1*e* is formed to the linear portion(s) 1*d*, 3*d* of the both body pieces 1, 3, so in case of removing the staple, it is made to pull out in a state that said projected portion and the linear portion press and grasp the staple, so that the staple removing function is promoted, and therefore there is effect that the staple can be correctly pulled out.

And besides, the present invention includes the nipper portions 1*c*, 3*c* being of nipper means at rear end portions of the both body pieces 1, 3, and therefore there is also effect that the staple can be readily pulled out by grasping effectively.

It will be appreciated that the present invention is not restricted to the particular embodiment that has been described hereinbefore, and that variations and modifications may be made therein without departing from the spirit and scope of the invention as defined in the appended claims and equivalents thereof.

I claim:

1. A staple remover comprising elongate channel-shaped body members each having opposed longitudinal flanges and an interconnecting web, a pivot pin extending through the flanges of the respective body members, gripping portions on the webs of the respective body members to one side of the pivot pin, and staple removing forks extending from the flanges of each body member on said one side of the pivot pin, wherein the flanges of each body member are extended on the other side of the pivot pin and interconnected at their ends by respective cross-bars to form nippers for gripping a staple therebetween when the gripping portions are squeezed toward one another.

* * * * *